US007192026B2

(12) United States Patent
Hopper

(10) Patent No.: US 7,192,026 B2
(45) Date of Patent: Mar. 20, 2007

(54) DUPLEXER HAVING AN AUXILIARY ROLLER THAT EXHIBITS SLIPPAGE

(75) Inventor: Craig Hopper, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 541 days.

(21) Appl. No.: 10/736,308

(22) Filed: Dec. 15, 2003

(65) Prior Publication Data

US 2005/0127599 A1 Jun. 16, 2005

(51) Int. Cl.
*B65H 29/00* (2006.01)

(52) U.S. Cl. ..... 271/186; 271/291; 399/401

(58) Field of Classification Search ..... 271/186, 271/65, 301, 291, 3.03; 399/401, 364, 309
See application file for complete search history.

(56) References Cited

U.S. PATENT DOCUMENTS 4,486,012 A * 12/1984 Bock et al. ..... 271/3.15
4,780,745 A * 10/1988 Kodama ..... 399/401
4,804,175 A * 2/1989 Grandjean ..... 271/225
4,928,127 A 5/1990 Stemmle
5,166,740 A 11/1992 Tanahashi et al.
5,192,068 A * 3/1993 Parker et al. ..... 271/34
5,271,614 A * 12/1993 Yamada et al. ..... 271/9.06
5,382,013 A * 1/1995 Walsh ..... 271/186
5,449,164 A 9/1995 Quesnel et al.
5,552,875 A * 9/1996 Sagiv et al. ..... 399/364
5,590,872 A 1/1997 Oominami et al.
5,720,478 A 2/1998 Carter et al.
5,887,868 A * 3/1999 Lambert et al. ..... 271/186
6,394,447 B1 5/2002 Kawai et al.
6,419,222 B1 7/2002 Morrison et al.
6,460,847 B1 10/2002 Boss

* cited by examiner

*Primary Examiner*—Patrick Mackey
*Assistant Examiner*—Thomas Morrison
(74) *Attorney, Agent, or Firm*—James R. McDaniel

(57) ABSTRACT

This invention relates to a duplexer, comprising; a media input nip, an auxiliary roller nip located downstream of the media input nip such that the auxiliary roller nip comprises an auxiliary drive roller that exhibits slippage so that the auxiliary roller nip maintains constant contact with a sheet of media to be duplexed, a backstop located downstream from the auxiliary roller nip, and a media output nip located adjacent to the auxiliary roller nip.

3 Claims, 2 Drawing Sheets

DUPLEXER HAVING AN AUXILIARY ROLLER THAT EXHIBITS SLIPPAGE

BACKGROUND OF THE INVENTION

1. Field of the Invention

This invention relates to a duplexer, comprising; a media input nip, an auxiliary roller nip located downstream of the media input nip such that the auxiliary roller nip comprises an auxiliary drive roller that exhibits slippage so that the auxiliary roller nip maintains constant contact with a sheet of media to be duplexed, a backstop located downstream from the auxiliary roller nip, and a media output nip located adjacent to the auxiliary roller nip.

2. Description of the Related Art

Prior to the present invention, as set forth in general terms above and more specifically below, it is known, in the duplexing art that printing on two sides of the media is achieved by a duplexer that ejects the media from the print engine, after printing on side one, into a duplex tray where the media is stopped by a backstop. This media tray jogs the media against one side and a roller nip closes on the new leading edge of the media, reverses the direction of travel of the media, and sends the media back to the print engine where the printing of the second side of the media can be completed. While this system is capable of duplexing media, this design depends upon consistency of the cut sheets of media. However, it is well known that the sheets of media are not always cut consistently and the side one/side two image placement may not match. Consequently, a more advantageous system, then, would be provided if the duplexing the device could provide a more accurate side one/side two image placement regardless of the type of media.

It is also known, in the duplexing art, to employ a variety of rollers that are utilized to place images on both sides of the media. Exemplary of such prior art is a duplexing device that uses rollers to grab the leading and trailing edges of the sheet of media. While these devices are also capable of duplexing the media, these devices do not constantly retain the media. Consequently, registration between the side one and side two images can be adversely affected. Alternatively, the devices may constantly retain the media, but they utilize complex electronics, sensors, motors, and controllers to coordinate the various rollers. Therefore, a further advantageous system, then, would be provided if the media were constantly retained within the duplexing device without additional control electronics, firmware, motors, or sensors.

It is apparent from the above that there exists a need in the art for the duplexing device that is able to provide a more accurate side one/side two image placement regardless of the type of media, and which at the same time it is capable of constantly retaining the media within the duplexing device. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a duplexer, comprising; a media input nip, an auxiliary roller nip located downstream of the media input nip such that the auxiliary roller nip comprises an auxiliary drive roller that exhibits slippage so that the auxiliary roller nip maintains constant contact with a sheet of media to be duplexed, a backstop located downstream from the auxiliary roller nip, and a media output nip located adjacent to the auxiliary roller nip.

In certain preferred embodiments, the media input nip transfers media that has been print on side one by the print engine to the auxiliary roller nip for duplexing. Also, the auxiliary roller nip further includes an auxiliary roller and an idler roller. Also, the auxiliary roller even further includes a clutch or other similar device that allows the media to slip within auxiliary roller nip. Finally, media output nip transfers the media to the print engine so that the print engine can print the side two image.

In another further preferred embodiment, the slippage exhibited by the auxiliary roller provides for constant contact between the media and the auxiliary roller nip and maintains accurate image placement on side one and side two.

The preferred duplexer, according to various embodiments of the present invention, offers the following advantages: excellent side one/side two image placement; constant contact between the media and the auxiliary roller nip; good stability; excellent durability; and good economy. In fact, in many of the preferred embodiments, these factors of simple and excellent side one/side two image placement and constant contact between the media and the auxiliary roller nip are optimized to an extent that is considerably higher than heretofore achieved in prior, known duplexers.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
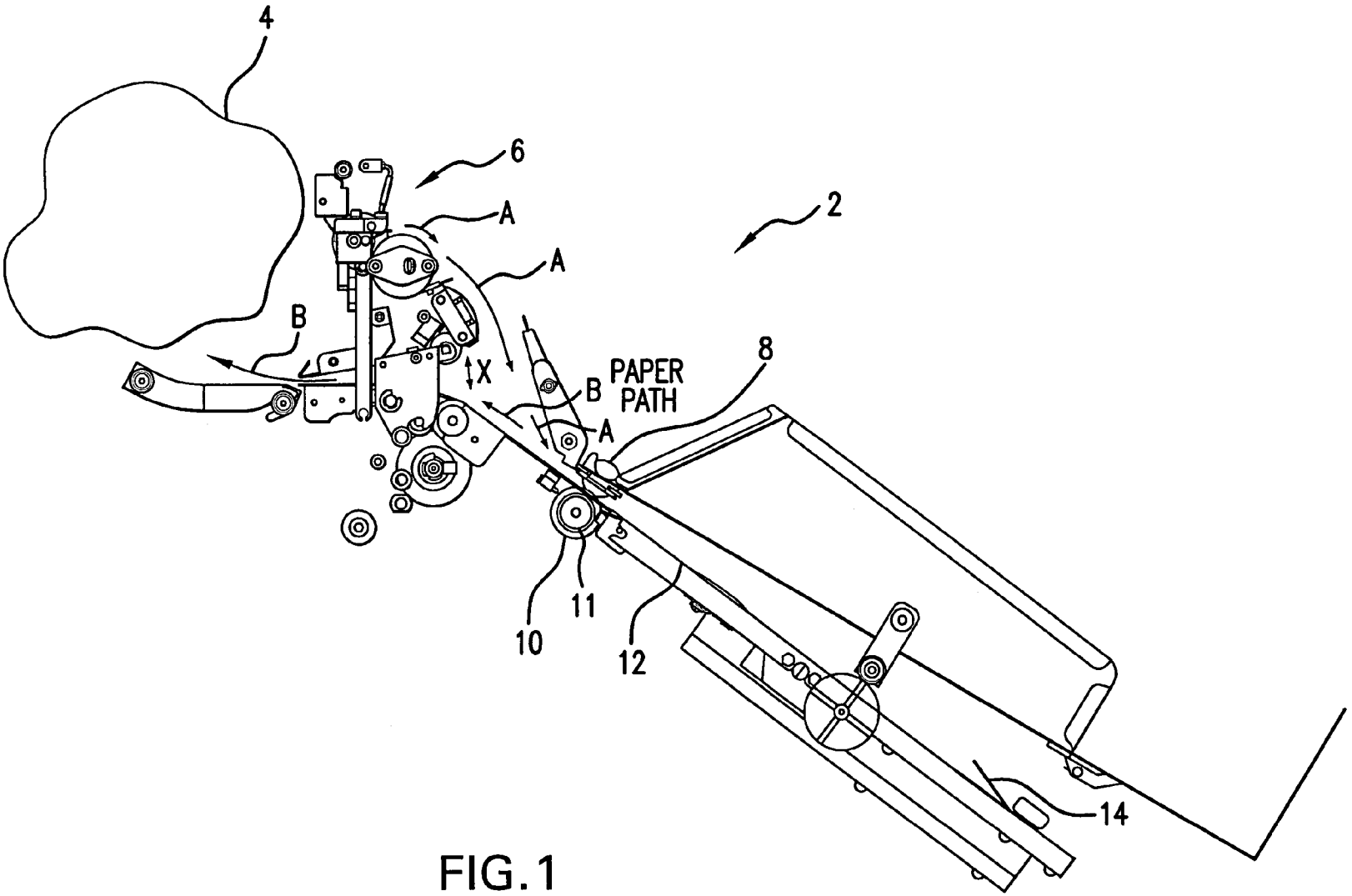
FIG. 1 is a schematic illustration of a duplexer having an auxiliary roller that exhibits slippage, according to one embodiment of the present invention.

With reference first to FIG. 1, there is illustrated one preferred embodiment for use of the concepts of this invention. FIG. 1 illustrates a duplexer 2 having an auxiliary roller that exhibits slippage. Duplexer 2 includes, in part, conventional print engine 4, media input nip 6, auxiliary idler roller 8, auxiliary drive roller 10, auxiliary drive roller shaft 11, lower guide plate 12, rotation slippage device 13 (FIG. 2), back stop 14, and media output nip 16.

Media input nip 6, preferably, is constructed so that it transfers sheets of media to be duplexed from print engine 4 to the nip located between auxiliary idler roller 8 and auxiliary drive roller 10, along the direction of Arrow A. Auxiliary idler roller 8, preferably, is any suitable, durable roller that is capable of retaining a sheet of media to be duplexed against auxiliary drive roller 10. Auxiliary drive roller 10, preferably, is any suitable, durable roller that also includes a rotation slippage device 13 or other similar device that will allow auxiliary drive roller shaft 11 to always rotate in the direction of Arrow Z, but will also keep auxiliary drive roller 10 from rotating when enough slippage resistance has been achieved. It is to be understood that a clutch, a bearing, a magnetic coupling, a mini-fluid coupling or the like could be utilized as a rotation slippage device. Auxiliary drive roller shaft 11, preferably, is constructed of any suitable, durable material that is capable of driving/retaining auxiliary drive roller 10. Lower guide plate 12, preferably, is constructed of any suitable, durable material that is capable of allowing sheets of media to traverse along its surface along the directions of Arrows A and B. Back stop 14, preferably, is constructed of any suitable, durable material that is capable of stopping the forward motion of the sheets of media along the direction of Arrow A. Media output nip 16, preferably, is constructed so that it transfers sheets of media to be duplexed from the nip located between auxiliary idler roller 8 and auxiliary drive roller 10 to print engine 4, along the direction of Arrow B.

Figure 2:
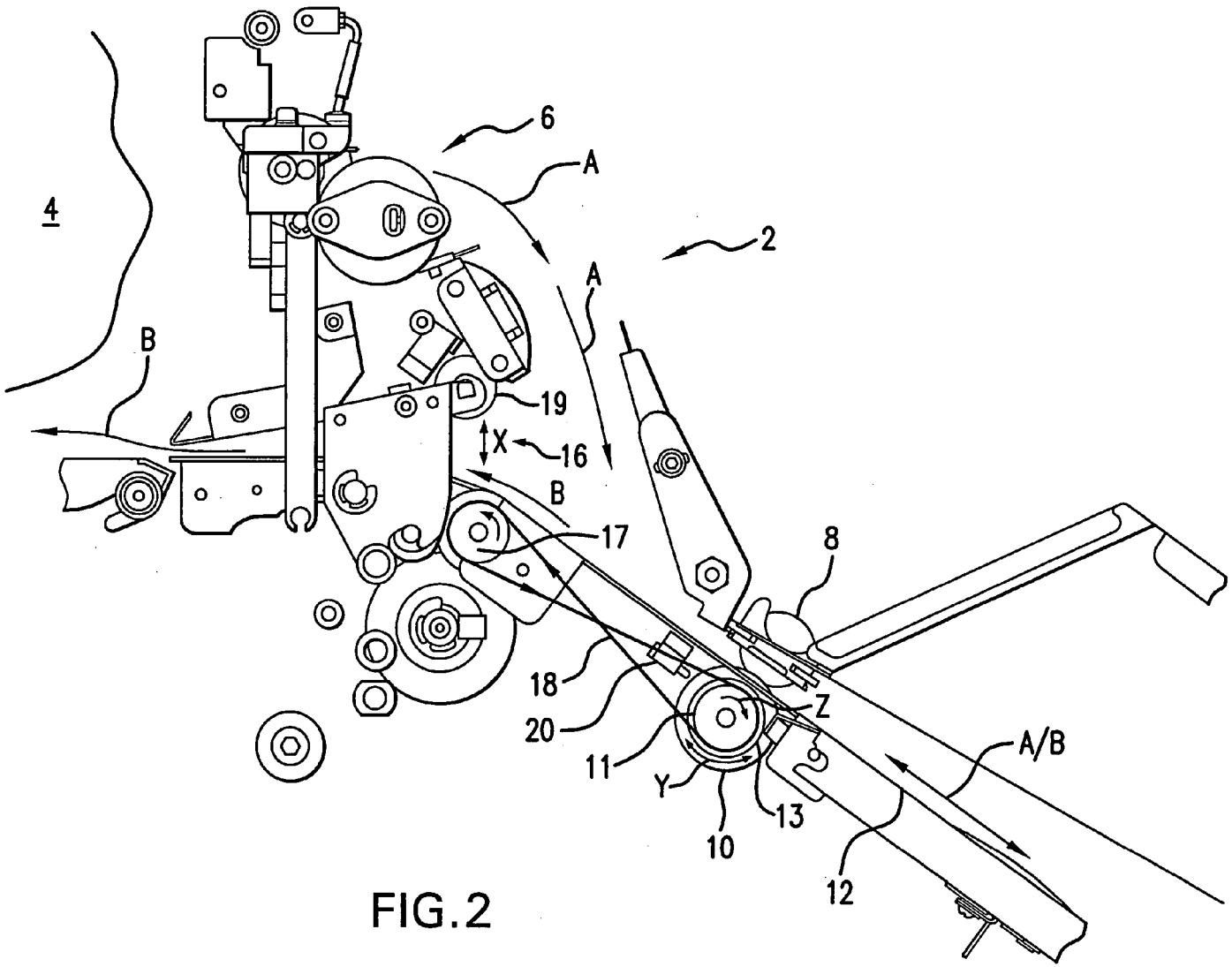
FIG. 2 is a close-up of the schematic illustration of FIG. 1, wherein the auxiliary roller nip is shown in greater detail, according to another embodiment of the present invention.

The operation of duplexer 2 will be discussed with reference to FIG. 2. As can be seen in FIG. 2, a sheet of media (not shown), that has already had an image placed on one of its sides, is transferred from print engine 4 through media input nip 6 along the direction of Arrow A. As the sheet of media is transferred along the direction of Arrow A, the leading edge of the sheet of media contacts the auxiliary roller nip formed between auxiliary idler roller 8 and auxiliary drive roller 10.

As can be further seen in FIG. 2, a drive belt 18 or other similar type of drive train or drive gear is used to continuously transfer power from a media output nip drive roller 17 to auxiliary drive roller shaft 11 so that drive roller shaft 11 rotates in the direction of Arrow Z. As the sheet of media is being fed by the auxiliary roller nip in one of the directions of Arrows Y, the leading edge of the sheet of media contacts back stop 14 (FIG. 1). Once the leading edge of the sheet of media contacts back stop 14, the sheet of media no longer easily slides along lower guide plate 12. This causes a resistance in the sheet of media to any further movement along the direction of Arrow A.

Once this happens, rotation slippage device 13 is activated. In this manner, drive roller shaft 11 still rotates along the direction of Arrow Z, but auxiliary drive roller 10 does not rotate. Even though auxiliary drive roller 10 does not rotate at this point in time, the sheet of media is still retained within the auxiliary roller nip. After the activation of rotation slippage device 13 has been observed, such as through a conventional optical feedback device 20, the idler roller 19 of media output nip 16 is rotated along a one of the directions of Arrows X so that it contacts media output nip drive roller 17. Once this occurs, the sheet of media is fed along lower guide plate 12 in the direction of Arrow B by the rotation of auxiliary drive roller 10 in the other direction of Arrows Y. The leading edge of the sheet of media then contacts the media output nip 16. The sheet of media is fed to print engine 4 so that an image can be placed upon the second side of the sheet of media.

After the sheet of media is fed to print engine 4, the idler roller of media output nip 16 is rotated along the other direction of Arrows X so that it no longer contacts media output nip drive roller 17. Once this is been accomplished, the process can be repeated to duplex further sheets of media.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for duplexing, comprising the steps of:

placing an image upon one side of a sheet of media by an image producing device;

transferring said sheet of media by a media input nip towards an auxiliary roller nip;

transferring said sheet by said auxiliary roller nip towards a backstop; by continuously contacting an auxiliary idler roller with an auxiliary drive roller to create said auxiliary roller nip; and causing said auxiliary drive roller to rotate in a first direction interacting between art edge of said sheet and said backstop such that substantially any further forward motion of said sheet is prohibited;

creating a slippage between said sheet and said auxiliary roller nip;

transferring said sheet by said auxiliary roller nip towards a media output nip; by causing said auxiliary drive roller to rotate in a second direction; and rotating a media output nip idler roller towards a media output nip drive roller in order to create said media output nip transferring said sheet to said image producing device in order to place an image upon the other side of the sheet of media; and rotating said media output nip idler roller away from said media output nip drive roller after said sheet of media is transferred to said image producing device in order to place an image upon the other side of the sheet of media.

2. The method, as in the claim 1, wherein said method is further comprising:

placing said images upon both sides of the sheet of media through the use of a print engine.

3. The method, as in claim 1, wherein said step of creating a slippage between said sheet and said auxiliary roller nip is further comprising:

creating a slippage between an auxiliary drive roller shaft and said auxiliary drive roller.

* * * * *

UNITED STATES PATENT AND TRADEMARK OFFICE

CERTIFICATE OF CORRECTION

PATENT NO. : 7,192,026 B2
APPLICATION NO. : 10/736308
DATED : March 20, 2007
INVENTOR(S) : Craig Hopper It is certified that error appears in the above-identified patent and that said Letters Patent is hereby corrected as shown below:

In column 4, line 20, in Claim 1, after “backstop” delete “;”.

In column 4, line 23, in Claim 1, after “direction” insert -- ; --.

In column 4, line 24, in Claim 1, after “between” delete “art” and insert -- an --, therefor.

In column 4, line 30, in Claim 1, after “output nip” delete “;”.

In column 4, line 33, in Claim 1, after “output nip” insert -- ; --.

Signed and Sealed this

Eighteenth Day of November, 2008

JON W. DUDAS
*Director of the United States Patent and Trademark Office*